United States Patent [19]

Hutchinson et al.

[11] 4,012,802

[45] Mar. 22, 1977

[54] MATTRESS FOUNDATION

[75] Inventors: Ronald G. Hutchinson, Naperville; Paul J. Dillon, Frankfort, both of Ill.

[73] Assignee: Simmons Company, Atlanta, Ga.

[22] Filed: Nov. 28, 1975

[21] Appl. No.: 636,090

[52] U.S. Cl. ..... 5/247; 5/255; 5/260; 267/105

[51] Int. Cl.[2] ..... A47C 23/00; A47C 23/02

[58] Field of Search ..... 5/247, 248, 255, 261, 5/260; 261/103, 105

[56] References Cited

UNITED STATES PATENTS

| | | | |
|---|---|---|---|
| 348,539 | 8/1886 | Tuttle, Sr. | 5/248 |
| 641,361 | 1/1900 | Beall | 5/247 |
| 803,933 | 11/1905 | Smith | 5/248 |
| 3,248,745 | 5/1966 | Gunlock | 5/247 |
| 3,546,723 | 12/1970 | Ciampa et al. | 5/247 |
| 3,574,241 | 4/1971 | Slominski | 5/247 |
| 3,825,960 | 7/1974 | Inman et al. | 5/247 |
| 3,914,809 | 10/1975 | Ciampa et al. | 5/247 |

*Primary Examiner*—Robert L. Wolfe
*Assistant Examiner*—Alex Grosz
*Attorney, Agent, or Firm*—Fitch, Even, Tabin & Luedeka

[57] ABSTRACT

A foundation in the nature of a bedspring for use beneath a mattress to support the same upon a bedframe or the like, having a base frame with wire columns thereon supporting a stable, elevated platform which is substantially unyielding in its central area under the loads normally imposed upon a bedspring and which, at least in its side edge areas, is resiliently yieldable in response to vertical load.

11 Claims, 7 Drawing Figures

Fig. 1.
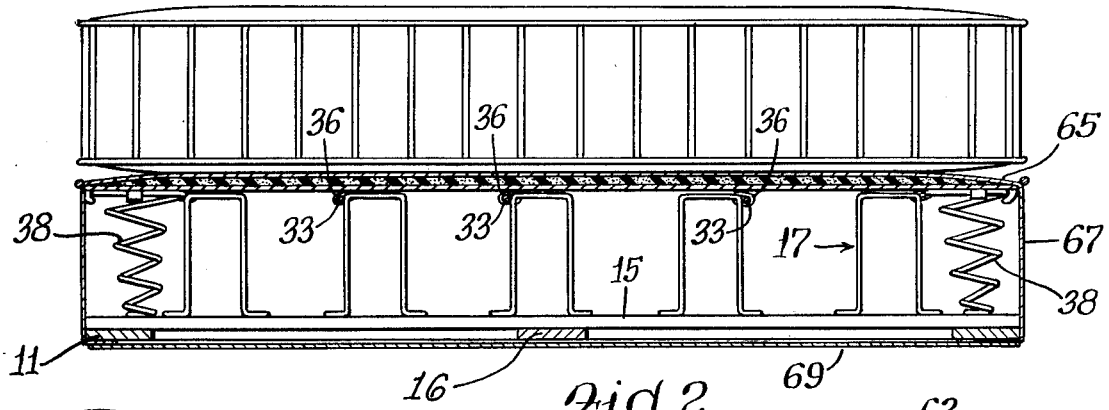
Fig. 2.
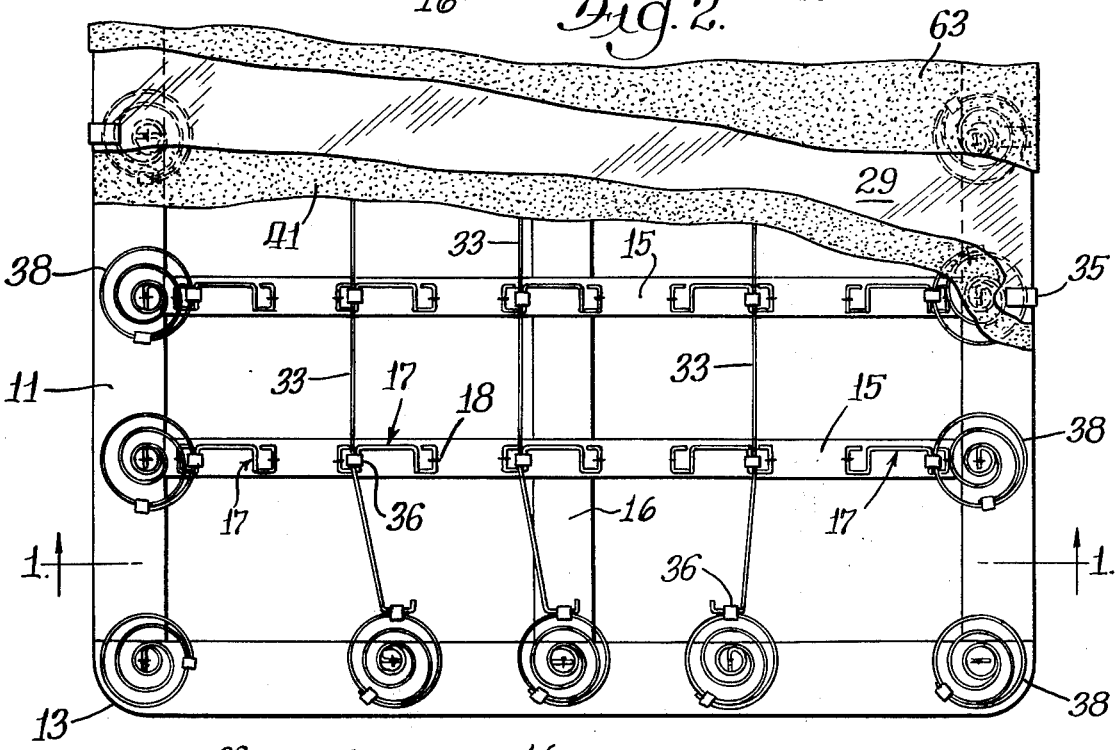
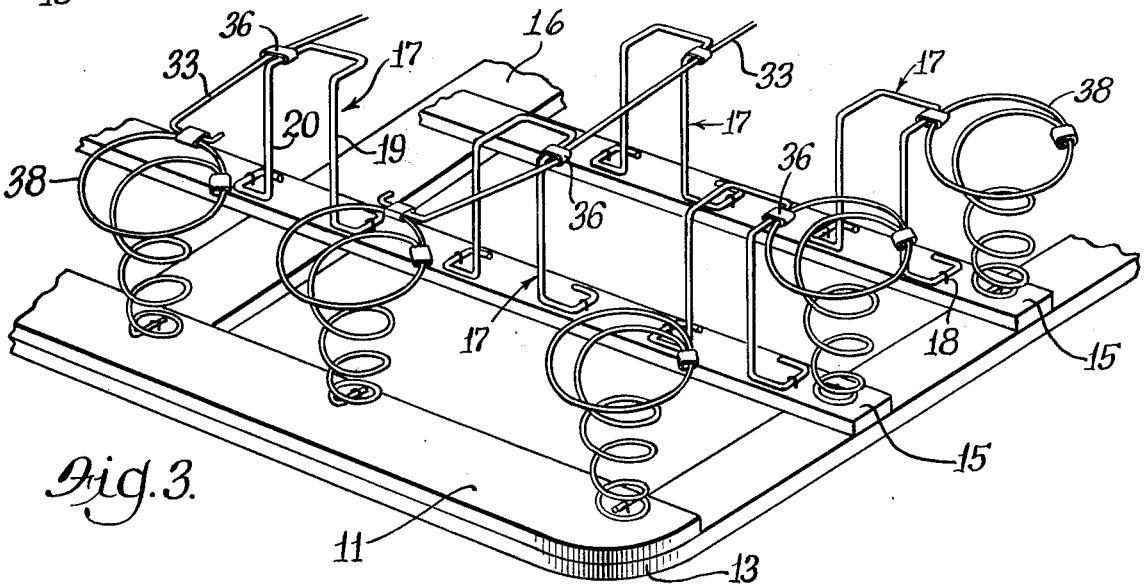
Fig. 3.

MATTRESS FOUNDATION

This invention relates to a foundation in the nature of a bedspring for supporting a mattress on a bedframe or bedstead.

More particularly, it relates to a mattress foundation which is designed to enhance the orthopedic serviceability of mattresses of otherwise conventional construction by providing them with undersupport which is adequately firm to give the mattress a feeling of overall firmness to a body reposed thereon, but which will also yield resiliently at least at its side edges to prevent a hard-edge sensation to the seated body and, at the same time, will enhance the resistance of the mattress to destruction of its edges under crushing loads by distributing the weight of the seated body over a larger area of the yieldable edge of the foundation to reduce the unit loading.

Such a foundation is described in copending application Ser. No. 532,879, filed Dec. 16, 1974, now U.S. Pat. No. 3,935,605 issued Feb. 3, 1976, also assigned to the assignee of this invention. The invention of that application proceeds upon the basis that the accommodation of the sleeping surface to the body or bodies reposed thereon is essentially the function of the mattress, and that the function of the underlying foundation is to provide non-sagging, non-tilting, essentially non-deflecting, planar support for the mattress to enable it to do its job properly.

Also, in the copending application it is contemplated that the foundation will adequately accommodate the incidental seating uses to which a bed is put by yielding to highly concentrated peripheral loads occasioned by a person seated at the edge of the bed for robing or disrobing, or simply using the edge of the bed as supplemental seating, as is commonly done in hotel rooms, dormitories, or the like.

Like the invention of the copending application, the foundation of this invention provides firm, relatively unyielding support for the greater area of the mattress in a manner which permits the mattress to serve its function of non-sagging longitudinal conformation to the reposed body or bodies, as the case may be, without substantial deflection of the foundation longitudinally or laterally. At the same time, the foundation of this invention adapts the bed of which it is a part to absorb high impact load without discomfort to the body imposing the load, and to withstand the highly concentrated and crushing loads to which the mattress border is subjected by a person seated at the edge of the bed.

It has the advantage, over the specific forms of foundations described in the copending application, that it is more adaptable to existing production and assembly techniques because the structural support elements, although not springs in any customary sense, are made of wire.

It is an object of this invention, therefore, to provide an improved mattress foundation which is economical to manufacture, which is constructed of materials and methods normally utilized in such manufacture and which enhances the function of the foundation to adapt the bed of which it is a part to absorb high impact load without discomfort to the body imposing the load.

Other objects and advantages of the invention will become apparent and the invention better understood by reference to the following detailed description read in conjunction with the accompanying drawings in which:

FIG. 1 is an end elevational view of a mattress supported by a foundation constructed in accordance with the invention, the foundation being shown in section to illustrate its construction;

FIG. 2 is a fragmentary plan view of the foundation illustrated in FIG. 1, partially broken away to illustrate the interior;

FIG. 3 is a fragmentary perspective view of one corner of the construction of the foundation of FIGS. 1 and 2, before the upholstery and cover are applied;

Figure 6:
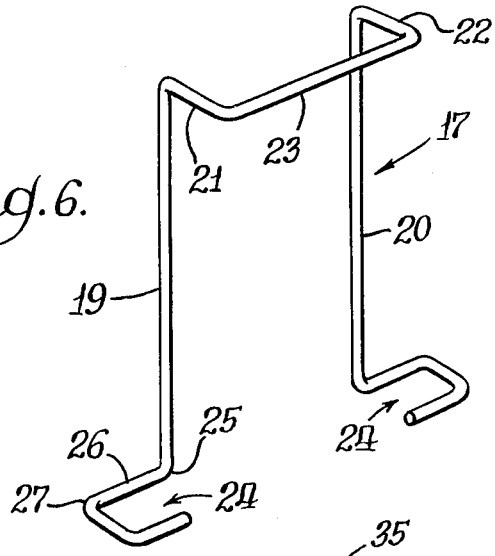
Figure 4:
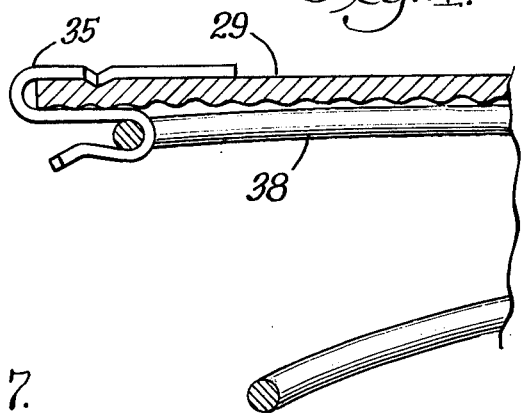
Figure 5:
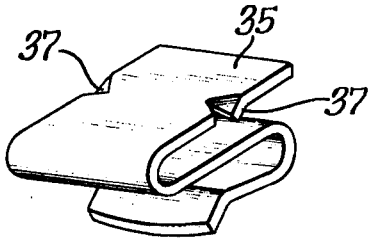
Figure 7:
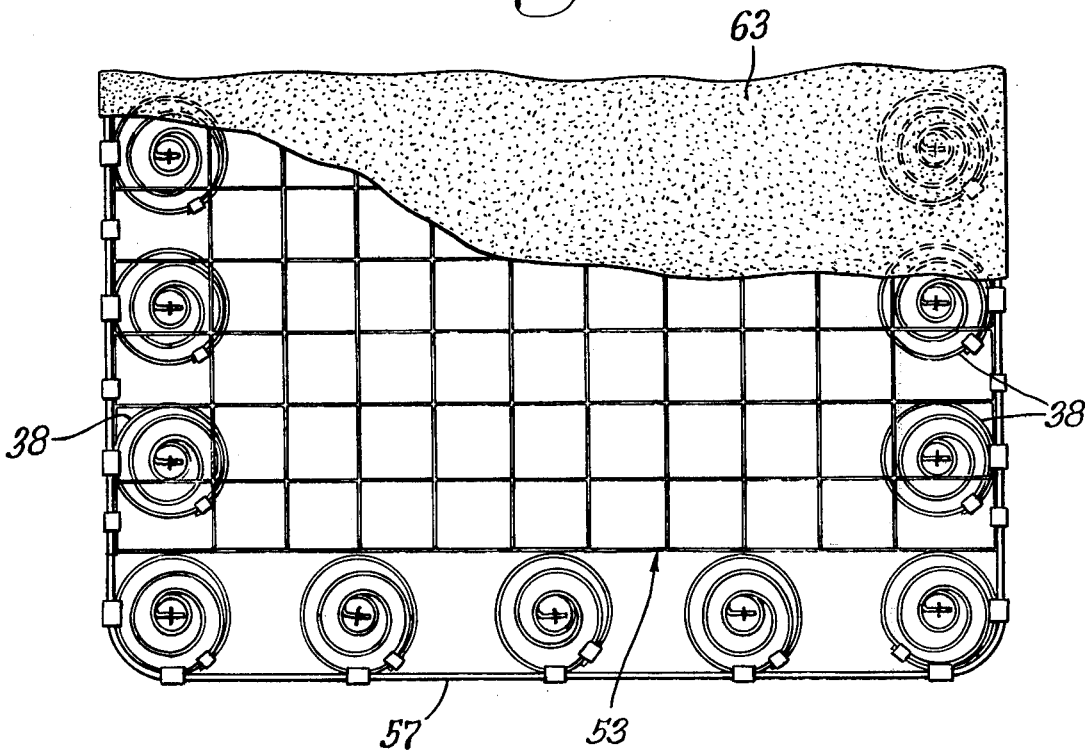

FIGS. 4 and 5 inclusive are fragmentary assembly and perspective views illustrating the use and form of two fasteners employed in the assembly of the foundation of FIGS. 1 to 3;

FIG. 6 is a perspective view of a wire column employed in the foundation of FIGS. 1 to 3; and FIG. 7 corresponds to FIG. 2 and illustrates a slightly modified form of the construction of FIGS. 1 to 3.

The embodiment of FIGS. 1 to 3 inclusive contemplates the use of a rectangular wooden base frame 11 having a periphery of two thicknesses of lumber with overlapping butt joints at the frame corners 13, which are formed in a convenient radius. Spanning the frame from side to side are a number of cross slats 15, which, depending upon the width of the frame, may also be supported by one or more longitudinal members 16, as is customary in the box spring frame construction. The slats 15 are aligned in a common plane and provide a base for the support of a plurality of upright support members 17 stapled or otherwise secured to the slats, as at 18.

Such wire support element 17 (compare FIGS. 3 and 6) comprises at least two spaced columns 19 and 20 bent at right angles at their tops to provide horizontal arms 21 and 22 which are joined together by an integral cross bar 23. Each column has an integral foot 24 formed by bending the wire at the bottom thereof in one right angular bend 25, to provide a first slat-engaging segment 26, followed by a succeeding bend 27 in the same slat-engaging plane to stabilize the support on the frame with columns 19 and 20 upright.

As may be seen in FIGS. 2 and 3, the tops of the wire support members 17 are integrated into a grid by the addition of longitudinal tie wires 33 secured to the support members 17 by conventional sheet metal wrapping clips 36. If desired, transverse tie wires (not shown) could also be added to the grid. With their tops thus united in a common plane, the support members 17 provide mutual support for an upper deck member which may take the form of a relatively stiff sheet 29 of plywood, chip or fiberboard, or, as will be seen hereinafter in a modified form of the preferred embodiment, of an open mesh or lattice of metal, plastic, or other suitably stiff sheet material.

As illustrated in FIGS. 1 to 3, the array of support members 17 secured to the slats 15 is surrounded by a peripheral row of wire springs 38, illustrated as coil springs, but which may be of other forms, stapled to the base frame about its periphery for the resilient support of the edge surface of the foundation.

In the embodiment shown in FIGS. 1 to 3, as the deck sheet 29 is a relatively thin and hard board, it is preferably insulated from the connected grid of the wire support elements 17 by a thin layer 41 of sound-deadening insulation such as a thin fibrous batt or layer of cushion foam to muffle the noise of contact between the wire grid and the undersurface of the deck sheet.

The deck sheet extends to the full dimension of the foundation, i.e., to cover not only the wire columns 17 but the peripheral springs 38 as well, and in that manner eliminates the need for a border wire at the upper edge of the construction. If desired, the deck may also be held to the grid by wire ties to the base frame to reduce the drum effect of the deck sheet 29.

With the deck sheet 29 extending to substantially the full dimension of the foundation, the peripheral spring elements are maintained in upright attitude by being secured to the deck member, a single sinuous edge clip 35 (FIGS. 4 and 5) embracing the upper convolution of the spring and the edge of the deck member, being sufficient for the purpose. The clip 35, formed of hardened steel band, has opposed edge tabs 37 struck downwardly from the side edges of its upper shank, the points of the tabs 37 resisting the removal of the clip 35 from the deck sheet 29, while the converging shanks of the lower loop confine the spring wire.

One specific formation successfully tested employed support members 17 fabricated of nine gauge spring steel wire, with columns approximately 5 and one-half inches high, spaced apart a distance of approximately eight inches along the slats. The slats of the base frame were spaced approximately eight and one-half inches on centers.

The columns 19 and 20 of the wire support members 17 are normally straight, but will bow slightly in absorbing a high impact load on the mattress they support. Once the impact has been absorbed, the legs again straighten and provide the nonsagging, planar support of the mattress.

The objectives of the invention are also adequately served in a minor modification illustrated in FIG. 7 in which a separate rectangular wire grid 53 replaces the solid deck sheet 29. The grid 53 also extends to substantially the full dimension of the foundation, but in this modification, a conventional border wire 57 encircles the construction and is secured with the grid 53 to the peripheral springs 38 by sheet metal clips.

The spacing of the wires in the grid 53 is substantially less than that between the adjacent ones of the longitudinal tie wires 33 which connect the tops of the support members 17, and the grid 53 provides a stiff supporting surface for a mattress.

Over the top of the deck sheet 29 or the deck lattice 53, as the case may be, a thin overall layer 63 of padding, which may be of fiber, or of foamed plastic material, or of a plastic mesh needled with reclaimed textile material, cushions the hard deck. Over all is the upholstery cover, which may comprise a top panel 65 (FIG. 1) sewn to a continuous peripheral side panel 67, and is drawn taut and stapled to the underside of the base frame 11. A dust cover 69 tacked or stapled to the underside of the base frame 11 closes the bottom of the foundation.

The padding layer 63 which tops the deck sheet 29 or the deck lattice 53 of the foundation immediately beneath the outer upholstery cover also cushions and thus helps to distribute concentrated impact load.

The foundation of the invention, by providing a flat, essentially rigid, unyielding platform for the mattress complements the function of the mattress in accommodating itself to the variety of body contours and load distributions in the many attitudes of the human form in repose. However, under abusive loading, particularly of an impact character, the platform is capable of sufficient load distributing ability to reduce or prevent damage to the foundation and/or substantial discomfort to the occupant. Moreover, when the bed inevitably serves as a bench along its edges, and particularly its side edges, resilient deflection of the edges eliminates an abrupt, hardedge feeling and, at the same time, permits sufficient load distribution in the transfer of the body weight from the mattress to the edge of the foundation to prevent the mattress border from being crushed.

While the invention has been described in connection with a preferred embodiment and an alternative, other alternatives, modifications, and variations may be apparent to those skilled in the art in view of the foregoing description. Accordingly, it is intended to embrace all such alternatives, modifications, and variations as fall within the spirit and scope of the appended claims.

What is claimed is:

1. A foundation in the nature of a bedspring for supporting a mattress, comprising a base;

a plurality of spaced support members each comprising a continuous length of wire bent to provide two spaced, straight, and parallel columns of equal height, an integral foot for each column defining a plane perpendicular to its column, and an integral connection between the tops of the columns providing at the top of each column a length of supporting wire parallel to the plane of said feet;

tie wires extending between and secured to the spaced support members at their tops to assemble them into a mutually bracing, planar, rectangular supporting grid parallel to and spaced above the base;

a row of springs substantially the height of said columns secured to the base along each of its side edges and flanking the assembly of said support members; and an overlying deck member coextensive with and supported by said assembly of wire support members and said flanking rows of springs, and serving to distribute localized loads applied to said foundation by an overlying mattress;

said foundation being substantially rigid and unyielding to normal bedding loads in the area of its upper surface overlying said support members but resiliently deflectable under concentrated load along the edges of said surface overlying said springs.

2. The foundation of claim 1 wherein said edge rows of springs are extended around both ends of the foundation to encircle the assembly of said supporting members with a peripheral row of springs beneath all edges of said deck member.

3. The foundation of claim 2 wherein said deck member is a solid sheet secured to said peripheral springs.

4. The foundation of claim 3 wherein the solid sheet deck member is underlayed with a thin pad to muffle its contact with said support members and springs.

5. The foundation of claim 2 wherein said deck member is a wire grid of smaller mesh than the grid formed by said tie wires and said support members and wherein the tops of said peripheral springs and the edges of the overlying wire-grid deck member are both secured to a border wire.

6. The foundation of claim 3 having a thin pad overlying the deck member and an outer upholstery cover over the top and sides of the foundation, and secured to the base thereof.

7. The foundation of claim 1 wherein the base is a wooden slat frame, and the feet of the columns of said support members are stapled to the wood frame.

8. In a foundation in the nature of a bedspring for supporting a mattress, the improvement comprising a support member for use in place of springs, said support member comprising a continuous length of wire bent to provide two spaced, straight, and parallel columns of equal height;

an integral foot for each column defining a plane perpendicular to its column; and an integral connection between the tops of the columns providing at the top of each column a length of supporting wire parallel to the plane of said feet.

9. The subject matter of claim 8 wherein said connection between columns is also bent to define a plane parallel to the plane of the feet.

10. The subject matter of claim 9 wherein said connection includes one straight length of wire having at each end a shorter length disposed at an angle to the straight length and merging perpendicularly into the top of the adjacent column.

11. The subject matter of claim 9 wherein said connection includes a straight length of wire having at its ends two equal shorter lengths of wire each mutually perpendicular to said straight length of wire and to one of the two columns.

* * * * *